US008074700B1

(12) United States Patent
Melino et al.

(10) Patent No.: US 8,074,700 B1
(45) Date of Patent: Dec. 13, 2011

(54) DUST CONTAINMENT SYSTEM

(75) Inventors: Charles E. Melino, Warwick, RI (US); Charles E. Melino, Jr., Warwick, RI (US)

(73) Assignee: ToolLab, Inc., West Warwick, RI (US)

( * ) Notice: Subject to any disclaimer, the term of this patent is extended or adjusted under 35 U.S.C. 154(b) by 0 days.

(21) Appl. No.: 09/262,656

(22) Filed: Mar. 4, 1999

(51) Int. Cl.
*E06B 9/56* (2006.01)

(52) U.S. Cl. ..... 160/327; 160/330; 160/368.1

(58) Field of Classification Search ..... 160/368.1, 160/327, 354, 330, 399, 402, 350; 454/170
See application file for complete search history.

(56) References Cited

U.S. PATENT DOCUMENTS 3,118,363 A * 1/1964 Burgess ..... 160/330 X
3,561,518 A * 2/1971 Johnson ..... 160/354 X
3,715,969 A * 2/1973 Burgess ..... 160/330 X
3,863,554 A * 2/1975 Boyd ..... 454/170
3,994,463 A * 11/1976 Baker ..... 160/350 X
4,139,101 A * 2/1979 Towfigh ..... 160/350 X
4,708,189 A * 11/1987 Ward ..... 160/330 X
4,770,086 A * 9/1988 Gabster ..... 160/350 X
4,794,974 A * 1/1989 Melino ..... 160/330
5,308,280 A * 5/1994 Dotson ..... 160/368.1 X
5,685,112 A * 11/1997 Fara ..... 52/202
5,924,469 A * 7/1999 Whittemore ..... 160/368.1

* cited by examiner

*Primary Examiner* — David M. Purol

(57) ABSTRACT

An improved dust containment system comprising a flexible sheeting supported by one or more poles. The flexible sheeting being held in place on the pole by one or more clamps. The clamps have a pair of handles that pivot about an axis and wherein opposite the handles are two jaws. Each jaw has a body area and a tip. The jaws being connected to their respective handles so that the tips of the jaws contact each other and wherein the body areas of the respective jaws are configured so that the body area of the jaws can fit around the pole without separating the tips of the jaws.

20 Claims, 7 Drawing Sheets

DUST CONTAINMENT SYSTEM

One of the most frequent problems encountered during any construction project is dust containment. Construction dust arises during demolition, renovation and in new construction as well. Dust is not just an aesthetic issue during construction. In demolition or renovation of particularly older structures asbestos and lead-based paint may be present. Therefore, dust is more than just a minor irritant to the workers and the public. In many older buildings asbestos or lead-based paint may be relatively harmless if untouched, however, once disturbed during construction these harmful materials become airborne and spread throughout the site and elsewhere causing potential health problems. The health problems caused by lead-based paint are a particular problem for workers who come into contact with it on a regular basis, as recent research maintains that the body retains lead and does not readily flush it from the system. As a result, continued exposure to lead causes lead to accumulate in the body until the high levels cause serious damage.

Asbestos exposure similarly causes serious health problems that are well documented. Asbestosis is a serious lung disease that has plagued workers who have been exposed to asbestos over long periods of time where proper protective precautions have not been taken. Even in new construction large quantities of dust can be generated, for example, in sanding drywall joint smooth. Thus, dust containment is an important consideration in any construction project.

In many activities where there are considerable quantities of dust being generated a curtain wall is frequently employed to prevent the dust from being spread from the work site to other parts of the site. These curtain walls are constructed of a flexible curtain that is supported by some means to cover an opening and separate the work area from areas to be protected from the dust. One example of such a curtain wall is disclosed in my earlier U.S. Pat. No. 4,794,974 the disclosures of which are incorporated herein by reference. In the '974 patent there is disclosed a curtain wall that comprises an elongated flexible curtain that is supported on a plurality of interconnected headers. Each of the headers is connected to the next by a flexible hinge and is supported against the ceiling by a support leg that is adjustable in length. Each support leg has a spring loaded foot to maintain pressure against the header.

Another approach to dust containment is a system sold under the trademark Quick Prop. As seen in FIG. 1 this system employs a pair of telescoping poles that are locked in place by a thumbscrew lock. One of the problems in using a thumbscrew lock is that it is difficult for a single worker to spread the poles to the proper height and keep them in place while at the same time tightening the thumbscrew. Plastic sheeting is draped over a rubber stopper at the top of the pole and locked in place by pushing a plastic pin through the sheeting and into a hole in the center of the rubber stopper. The plastic sheeting is fastened to the poles with plastic sleeve clips. One of the major drawbacks of the Quick Prop system is that the poles are not spring loaded. Another drawback is that the Quick Prop system does not provide a fastening means for working with suspended ceilings.

Another product currently available is sold under the trademark Zipwall This product employs telescoping poles that are held in position by twisting the upper pole clockwise to lock and counterclockwise to unlock. At the top of the upper pole is a head plate that is provided with a pair of orifices. The plastic sheet is held in place at the top of the pole by a plate that has pegs arranged to mate with the orifices. With the plastic sheet in place the upper pole is extended into place against the ceiling and held in place by spring action of a spring in a jack on the upper pole and also by the twist lock mechanism. One of the drawbacks of the Zipwall system is in the head and plate arrangement. In order to adapt the Zipwall system to a variety of ceiling surfaces, the plastic head and plate are connected to the upper pole by a thin neck that may not stand up to the abuse of a construction site. Another deficiency of the prior art is that there was no way of adapting the system to use with suspended ceilings.

In construction projects, a dust containment system must not only be effective restricting the spread of dust throughout the project but also must be readily assembled and disassembled as time is of the importance in many projects, particularly today when many contracts provide incentives for early completion of the project and severe penalties for delays. In addition the system must be durable to withstand the rigors of a construction site. Accordingly, it is an object of the present invention to provide an improved dust containment system that is easy to erect and dismantle while at the same time providing superior dust containment.

It is also an object of the present invention to provide a dust containment system that is particularly suitable for suspended ceiling installations.

It is a further object of the present invention to provide a clamp that is particularly adapted for use in the system with respect to suspended ceiling installations.

It is a still further object of the present invention to provide a gasket for sealing between a pole and a wall surface in a dust containment system.

It is another object of the present invention to provide a system with pre-applied peel and stick tape to provide a superior seal to prevent dust infiltration, while saving time for the installer.

DETAILED DESCRIPTION OF THE INVENTION

Figure 2:
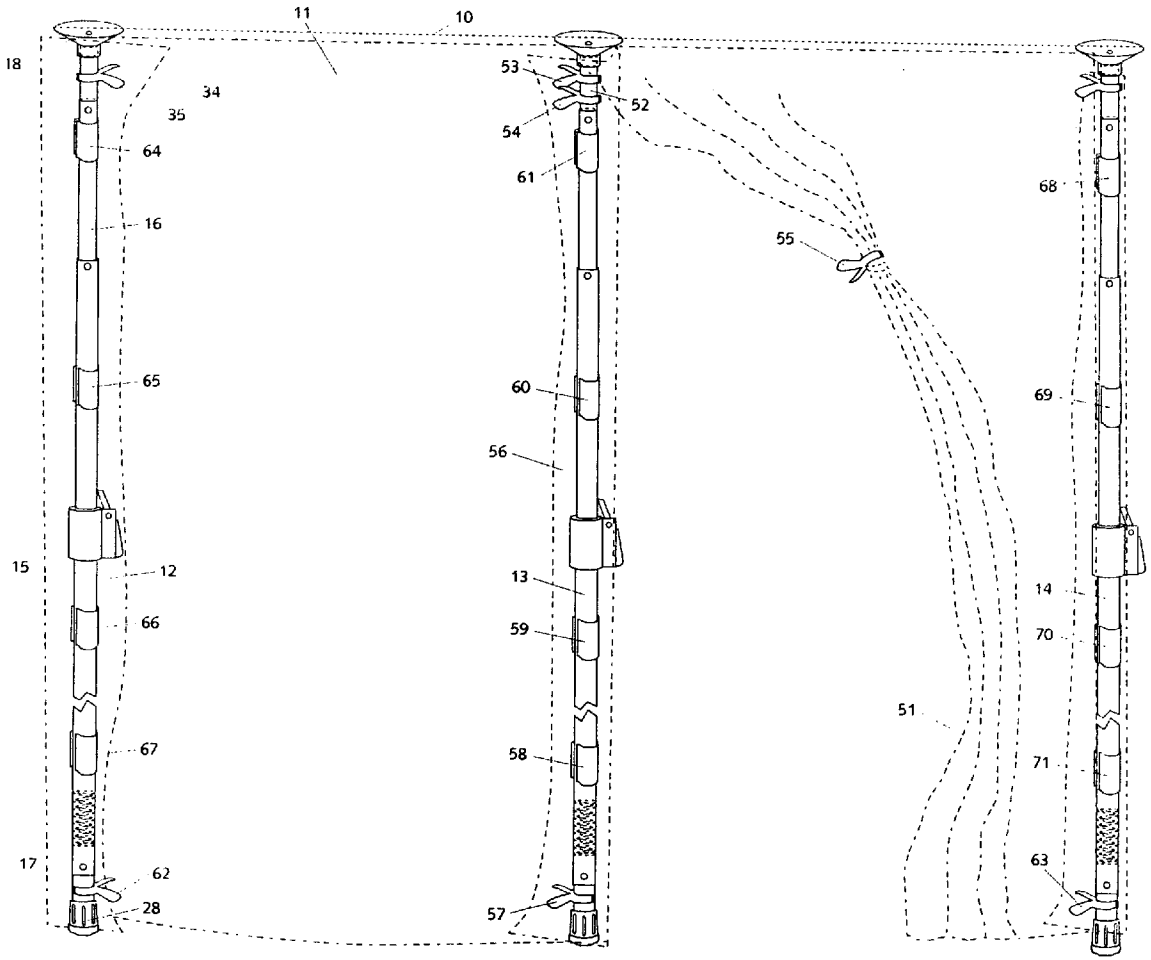
FIG. 2 shows the dust containment system of the present invention for a hard ceiling application.

FIG. 2 shows an installation 10 when a curtain is set up against a plaster or Sheetrock ceiling, i.e., a hard ceiling. As shown in FIG. 2 there is a flexible sheet material 11 that is supported by one or more poles 12, 13, 14. The flexible sheet material is typically a polyethylene or other polymeric material. The sheeting can also be a cloth material such as canvas also. The sheeting material should be thick enough so that it is not readily punctured or ripped. Where the sheeting is polyethylene or polypropylene, it should have a thickness of about 1 mil or greater and preferably, 3 mil-5 mil thick. When the sheeting becomes to thick it becomes too difficult to handle easily and the additional weight creates problems.

The poles may be a unitary structure or may preferably comprise two members, a main body 15 member and a secondary body member 16. More preferably the pole comprises, in addition, a third member, a spring loaded base 17. The relationship of the spring loaded base to the remainder of the pole is shown in more detail in FIG. 4. In a preferred embodiment at least one of the body members is hollow for at least a portion of its interior as the poles are preferably telescoping whereby one pole is adapted to retract into or extend out of a portion of the interior of the other member. A locking mechanism is provided to lock the poles in position. One locking mechanism has a ring that is attached to the outer surface of the upper end of the main member. Extending from the ring is a pair of flanges. A pin having a first end is supported by the first flange. The second end of the pin is supported by the second flange. Rotating about the pin is a spring mounted jaw having a first end and a second end. The first end of the jaw is adapted to contact the outer surface of the secondary body member and lock the secondary body member in place. The upper body member has an upper end and a lower end. The lower end is adapted to telescope into the main body member. The upper end is adapted to be in contact with a ceiling or other surface for the area to be enclosed by the curtain. The arrangement of the poles is described in more detail in my co-pending patent application Ser. No. 09/270,884 the disclosure of which is incorporated herein by reference.

Figure 4:
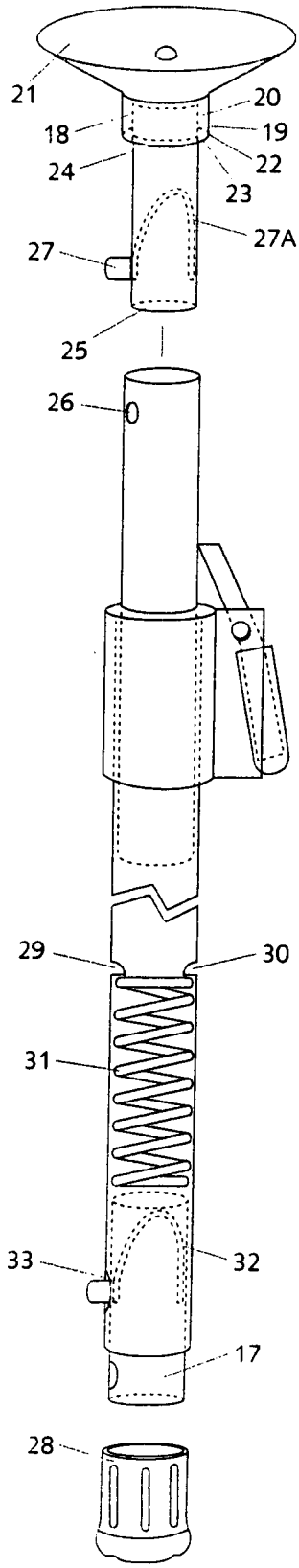
FIG. 4 shows an improved pole of the present invention.

Attached to at least one end of each pole is a flared flexible stopper assembly 18. The stopper 19 may be made of any suitable flexible material such as rubber or a thermoplastic material. As shown in FIG. 4, the flexible stopper 19 may be in the shape of a cone or a bell having a neck and a base 21 and an apex 22. Apex 22 has an orifice 23 that receives one end of rod stub 24. The other end 25 of the rod stub is adapted to be received by an open end of the top or the bottom of the pole. The rod stub 24 has a bayonet type of connection to the pole, i.e., a button 27 connected to a spring 27A on the rod stub mates with the orifice 26 in the pole. The base or wider portion of the stopper is the part of the stopper that contacts the wall, floor or ceiling surface.

Other flexible stopper designs are also possible. The flexible stopper is snapped onto the top of the pole or the uppermost body member. In another embodiment, the apex of the stopper has a hollowed out portion into which the top portion of the pole may be inserted and removably retained therein by friction or other suitable means. For a hard ceiling application, the flexible stopper is placed at the top of the pole so it contacts the ceiling. Where a suspended ceiling is present, the flexible stopper is placed at the base of the pole instead.

The base of the pole 28 or the lowermost body member if the pole has more than one member, has a spring loaded member 17 at the base. The spring loaded member may, for example, be a member that has an inner end and an outer end whereby the inner end is retained in the top portion of the pole and the outer end extends outwardly from the end of the pole. The spring loaded member is retained in the base of the pole in such a way that it has the property that when a force is placed on it in a downward direction parallel to the length of the pole, the spring forces the member outwardly from the pole and aids and assists in holding the pole in place against the appropriate surface. In another embodiment, shown in FIG. 4, a locking spring 31 is in place between notches 29 and 30 and the top of pole base 17. Pole base 17 is held in place with retainer spring 32, which protrudes through a small hole in pole base 17, then through slotted hole 33 in the outer tube. The slot allows up and down movement of the pole base which compresses the spring 31. Flexible stopper assembly 18 is removed from the top of the pole when there is a suspended ceiling application In order to set up the system of the present invention, a top corner of the sheeting 34 is fastened to the neck of the flared flexible stopper by any suitable means. In a preferred embodiment, the sheeting is fastened to the neck by a clamp 35. The clamp of the present invention is one such suitable clamp and is shown in more detail in FIG. 3. The clamp preferably has a pair of handles 36 and 37 that pivot about an axis 38. Opposite the handles are two jaws 39 and 40 that are connected to their respective handles and arranged in such a fashion that their tips 41 and 42 are in face to face contact. The body areas 48 and 49 of the respective jaws are preferably configured so that the interior of the jaws 43 can fit around the pole without separating the tips of the jaws from their face to face or abutting contact. A spring 44 set inside the handle provides a suitable force to press and hold the tip of each of the jaws toward the other. The spring is preferably a torsion spring held in place by the rivet or pin that constitutes the axis 38 the handles and jaws rotate about. Each of the respective jaws ends in a tip shown as 41 and 42 that is preferably no more than 1/16th of an inch thick. The thinness on the tip is preferred as it limits the lifting of the ceiling tiles 45 to a minimum and therefore limits the size of the opening for air and dust to escape. Opposite the tips 31 and 32 of the clamp are flanges 46 and 47 that form with the tips a generally U-shaped opening. The generally U-shaped opening provides an area in the jaws for clamping the sheeting to the suspended ceiling support 50 to be held in place.

In setting up the system, initially, the flexible stopper should be set 2"-3" from the top of the sheeting to allow for taping of the sheeting to the ceiling. See FIG. 4. The assembly is snapped into the top of the support pole and the curtain is set into place up against the ceiling. Starting approximately 3" away from the wall, the support pole is extended thus lifting the curtain to the ceiling. The curtain is lifted to the ceiling until the pole spring is compressed and locked thereby holding the entire pole assembly firmly between the floor and the ceiling. Additional support poles are erected in the same manner as necessary. The curtain should be stretched out as installation continues to avoid sagging at the ceiling. In addition, placement of the poles on the same side of the curtain wall will provide a better seal at the ceiling. Poles can be spread up to about approximately 16' apart, depending on the weight of the sheeting. However, the closer the poles are to each other the more stable the containment system's arrangement will be.

If an access flap 51 is desired, two pieces of sheeting should be overlapped by about 12" or so, then clamped to the pole or the neck 52 of a flared flexible stopper assembly using the clamp 53, of the present invention. Preferably, a second clamp 54 is added just below the first for additional strength and stability for the seal. When the access flap is to be opened the third clamp 55 can be used to hold the access flap in an open position. The stationary side of the access flap 56 is fastened to the pole at the bottom with another clamp 57 and along the length of the pole with one or more sleeve-clips 58, 59, 60 and 61. The operating side of the access flap may be fastened closed by clamping it to the support pole with one or more clamps 55. The flap may also be held open using a clamp by pulling the sheeting back in a bunch and clamping it to itself 55 or by clamping it back to one of the support poles 14.

Because the clamps fasten quickly and securely they are particularly suitable for use in access doors for temporary enclosures. These doors are required to be quickly and easily set up, provide quick entry, a good air seal and low cost. Presently in some applications, a cloth door is used having a velcro flap sewn in. This type of door is expensive and difficult to take apart and clean. Another type of door that is currently in use is a heavy vinyl door unit with a zipper flap sewn in. This door is also expensive and must be cleaned by hand with a sponge. In addition there is also a self adhesive peel and stick zipper which is applied to the flexible sheet. This zipper also becomes expensive because they are usually disposed of after only one or two uses. The access door of FIG. 2 is capable of being quickly and easily set up. In addition, the access door provides a good air seal and does not require additional cost because the poles, clips and clamps are the same ones already used as the wall structure.

Once the poles are in place, the curtain is fastened to the bottom of each pole with a clamp 57, 62, and 63. More clamps can be added to the poles to help stabilize the structure. It has been found that clamps in or around the center of the pole provide the best stability for the structure. Where the ends of the curtain are being joined to the walls of the building, sheeting is fastened throughout the height of the support pole with one or more sleeve clips 64, 65, 66, 67, 68, 69, 70 and 71.

Figure 1:
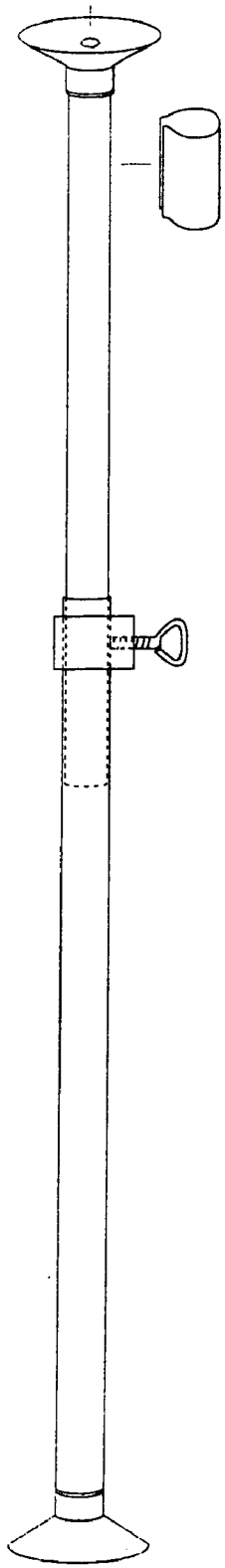
FIG. 1 is an example of a pole arrangement used in a prior art dust containment system.

The clips that fasten the sheet to the vertical support poles must hold the flexible sheeting tightly yet be capable of being easily removed. Plastic sleeve clips as shown in FIG. 1 have been previously used. Although these clips are inexpensive there is a significant trade off that must be made. When they are made strong enough to hold the sheeting tightly, they are difficult to remove from the pole. When they are rendered easier to remove from the pole then they typically do not hold the sheeting in place as tightly as it should be. Steel spring clips have also been used. These clips have the same drawbacks as the plastic sleeve clips, however. The problems of the sleeve and steel spring clips have been solved by the clamp shown in FIG. 3. The clamp holds the sheeting firmly to the ceiling by gripping it to the resilient neck of the flexible stopper. Sheeting can then be fastened throughout the height of the pole by one or more of the improved clamps. In the prior art Zipwall method, the base of the pole does not contact the floor. Instead, the pole base contacts the sheeting which is passed under the pole base. This approach, however, can cause the pole base to slip out of place. The system of the present invention does not have this problem.

Figure 6:
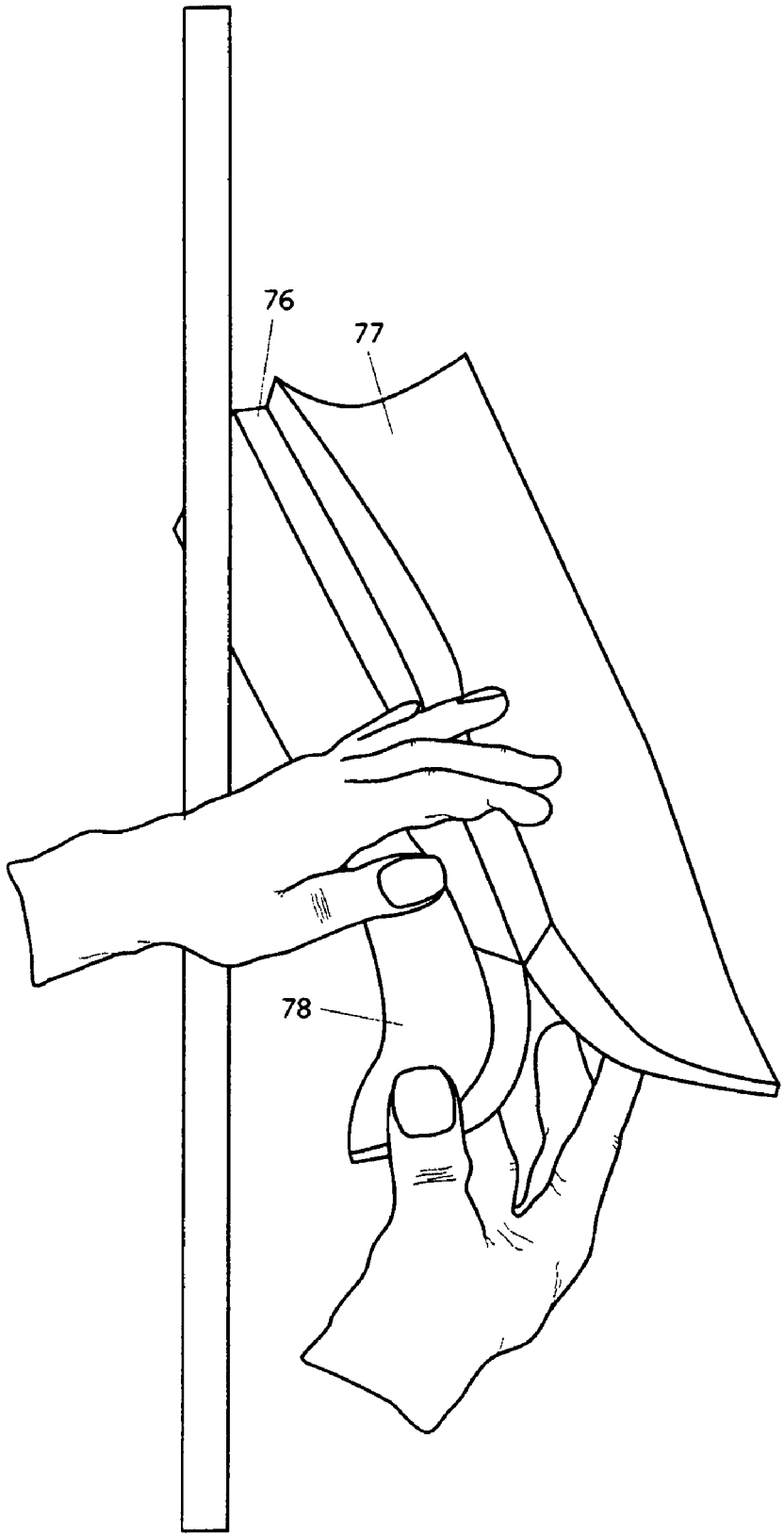
FIG. 6 discloses an improved seal for sealing the area between the side of the system and an adjoining wall surface.
Figure 7:
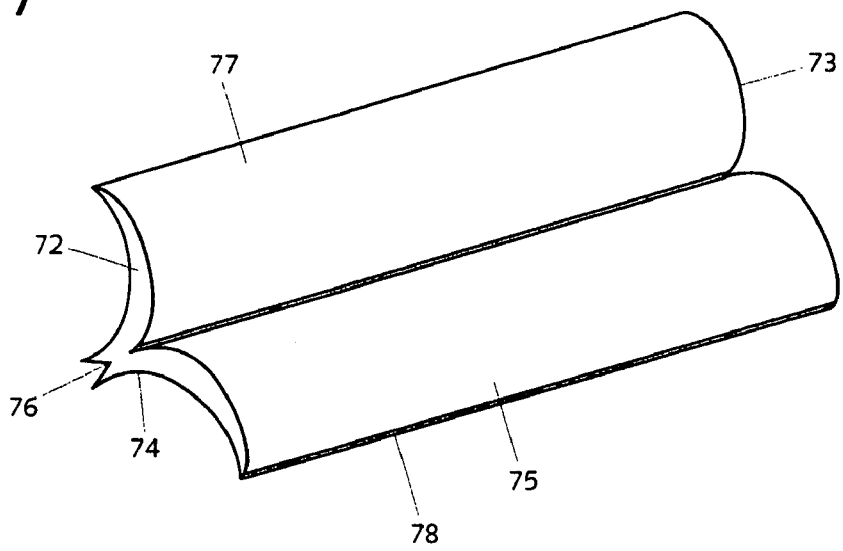
FIG. 7 shows the seal accessory of FIG. 6.
Figure 8:
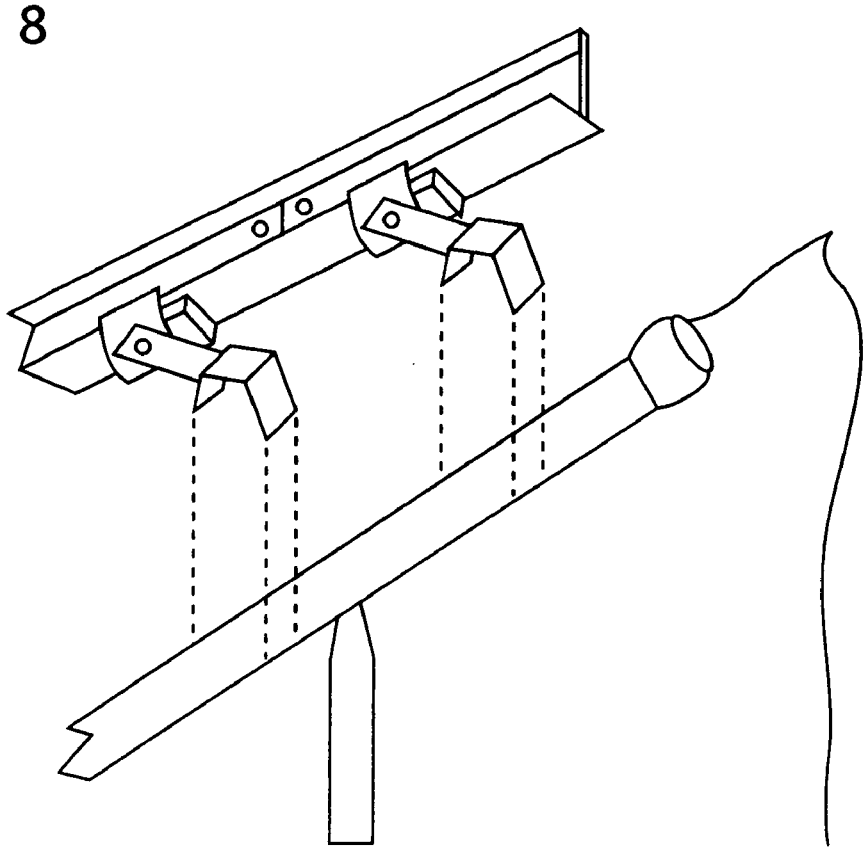
FIG. 8 shows a prior art kit for use with suspended ceilings in contrast to the improved dust containment of the system of the present invention.

If an absolute seal is not required along the walls, tape can be eliminated and a gasket shown in FIGS. 6 and 7 can be used to join the curtains to the building walls. The gasket has a top end 72 and a bottom end 73 and is about 18" or so in length. However, virtually any length is suitable. The gasket is preferably made of a foamed plastic material. The gasket preferably has a pole side 74 and a wall side 75. The pole side has a notched area or groove 76 that extends from the top end to the bottom end that is adapted to mate with the outside surface of the pole. Where the pole is rounded, the pole side of the gasket should have a rounded notch or grooved surface extending from the top end to the bottom end that is intended to mate with the outer surface of the pole. The wall end of the gasket ends in a pair of wings 77 and 78 that extend outwardly from the core and butt up against the wall surface creating a seal to provide dust containment. Preferably, the wings extend apart from each other so that when they butt up against the wall one wing is generally on one side of the curtain and the other wing is generally on the other side of the curtain.

Figure 3:
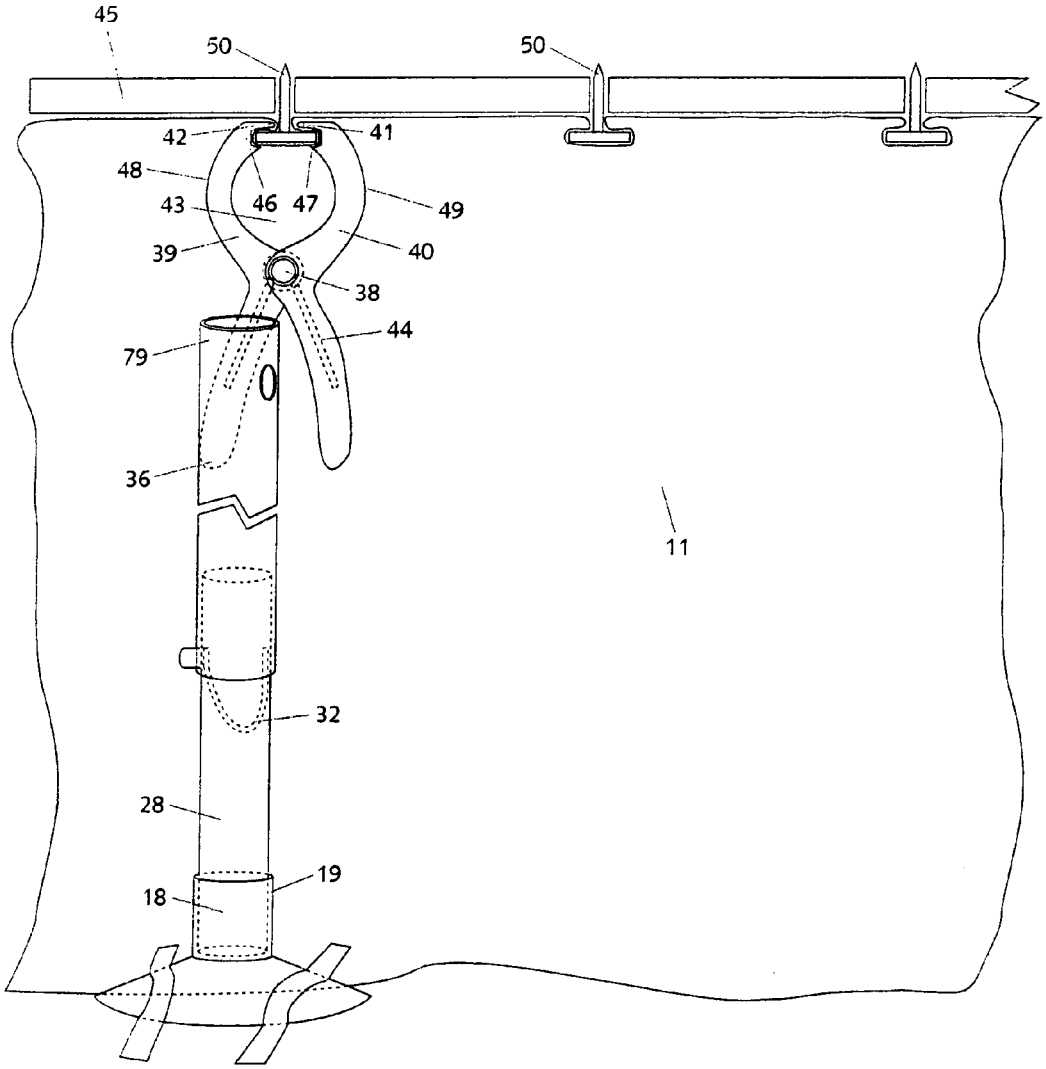
FIG. 3 shows the system of the present invention as used in connection with a suspended ceiling installation.

For a suspended ceiling set-up, a clamping arrangement as shown in FIG. 3 may be used. Suspended ceilings typically have a plurality of ceiling sections that are supported along each edge by an inverted T-shaped grid system with clamps that should preferably have the notched jaw tip described above. These clamps are adapted for quickly securing sheeting to a T-frame system. The sheeting may be transverse to the T-frame in any direction and an access flap can be set up by installing a support pole as shown in FIG. 2, and attaching the support pole to the ceiling as shown in FIG. 3. In addition, a line pole can be added about every 12' or so for added stability in case there is a breeze when a door or window is opened. A line pole is a pole set up between the end poles that is not used connection with an access door. An extra pole should also be used whenever the curtain joins a wall, whether taped or joined with the seal of FIG. 5.

The unique jaw shape of the clamp of FIG. 3 is particularly useful in applications that use a suspended ceiling. These ceilings are very common in commercial buildings where common plaster or Sheetrock ceilings are not typically used. In the past these suspended ceilings presented significant problems for telescoping spring loaded pole structures because these systems depend on the spring pressure to create the friction needed to hold the poles in a vertical position and using telescoping poles tended to lift the ceiling tiles eliminating the required friction. One approach for suspended ceiling applications used various grommets and clips designed to snap onto flexible sheeting. These systems can be wired to the T-frame of a suspended ceiling. While these systems hold the sheeting firmly in place, they generally leave a gap between the ceiling and the top of the sheeting. In addition, these systems are time-intensive in fastening and wiring these systems in place. The system disclosed in FIG. 3 solves the problem of suspended ceilings by holding the sheeting snugly against the ceiling tile and it can be set into position in just a short period of time using no additional tools. This clamping system also has superior strength. Using 4 mil polyethylene sheeting each clamp will support up to 20 pounds of this sheeting.

As shown in FIG. 3 the top of the support pole should be able to grab or hold onto the clamp. This can be accomplished by making the clamp handle narrow enough to fit inside the top 79 of the support pole tubing and also, when clamped over the T, the handle of the clamp needs to be at or near vertical position so that the support pole can be set up in a vertical position. Although the support poles are not needed to hold the sheeting in place against suspended ceilings when using the clamp, they are still needed for clamping the access flap closed.

Figure 5:
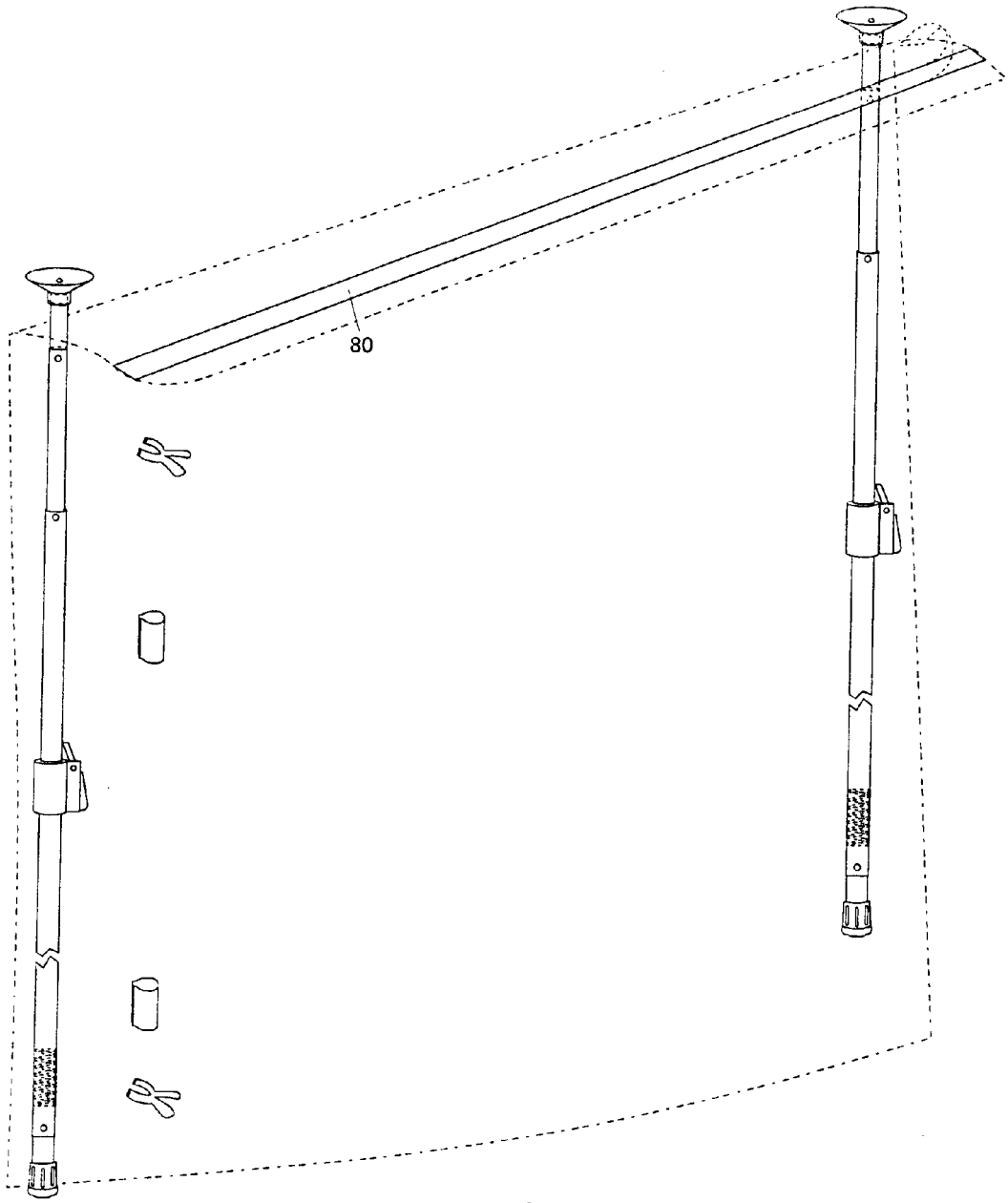
FIG. 5 shows the system of the present invention with the peel and stick feature.

Another feature of the system of the present invention is shown in FIG. 5. This is the presence of a peel and stick tape 80 which is pre-applied to the top edge of the sheeting for a quick superior seal to the ceiling. The peel and stick feature can also be applied to the sides and bottom of the sheeting. Tape placement with a peel and stick tape can be done much faster and more accurately in a factory setting than on the job-site and with the addition of the peel and stick release paper, the contractor can position sheeting against the ceiling and reposition if necessary before removing the release paper and sticking sheeting to the ceiling. Application of the peel and stick tape is best done with a spatula-shaped pole attachment. The peel and stick feature adds to job safety because there is less work being done from a step ladder. While there are presently pre-taped painter's masking films in use, these are very lightweight films not the heavier sheeting used by asbestos and lead abatement workers for a positive seal against dust.

The heavier sheeting used for temporary enclosures would be very difficult to maneuver into position once the sticky side of the tape was exposed. The need for the release paper is therefore essential for easy positioning of the sheeting against the ceiling before exposing the sticky tape surface.

We claim:

1. An improved dust containment system comprising a flexible sheeting supported by one or more poles, said flexible sheeting being held in place on said pole by one or more clamps, said clamps having a pair of handles that pivot about an axis and wherein opposite the handles are two jaws, each jaw having a body area and a tip, said jaws being connected to their respective handles so that the tips of said jaws contact each other and wherein the body areas of the respective jaws are configured so that the body area of the jaws can fit around said pole without separating the tips of the jaws.

2. The system according to claim 1 wherein said poles having on at least one end thereof a flexible stopper having a base which contacts a surface, said flexible stopper being in the shape of a cone.

3. The system according to claim 2 wherein the flexible stopper has a neck, and an apex, said apex being a portion of the stopper that is connected to the pole.

4. The system according to claim 1 wherein the clamp has a spring set inside the handles to provide a suitable force to press and hold the tip of each of the jaws toward the other.

5. The system according to claim 4 wherein the spring is a torsion spring held in place by the axis the handles and jaws rotate about.

6. The system according to claim 5 wherein each of the jaws ends in a tip that is no more than 1/16th of an inch thick.

7. The system according to claim 6 wherein opposite the tips are flanges that form with the tips a generally U-shaped opening.

8. The system according to claim 1 further comprising a gasket for use between a wall and a pole, said gasket comprising a top end and a bottom end and a pole side and a wall side, said pole side having a groove that extends from the top end to the bottom end, said groove being adapted to mate with an outside surface of the pole and wherein said wall side of the gasket ends in a pair of wings that extend outwardly from a core.

9. The system according to claim 8 wherein said wings butt up against the wall creating a seal to provide dust containment.

10. The system according to claim 9 wherein said wings extend apart from each other so that when they butt up against the wall, one wing is on one side of said sheeting and the other wing is on the other side of said sheeting.

11. The system according to claim 1 wherein there is a peel and stick tape on an edge of the sheeting.

12. An improved dust containment system for use with a suspended ceiling comprising a tile and a tile support said system comprising a flexible curtain supported by one or more poles, said poles having a top end and a bottom end, said pole having on said top end thereof a clamp, said clamp holding said pole to said tile support of the suspended ceiling, said clamps having a pair of handles that pivot about an axis and wherein opposite the handles are two jaws, each jaw having a body area and a tip, said jaws being connected to their respective handles and arranged so that the tips of said jaws clamp onto said tile support and one of said handles is inserted into an opening in the top end of said pole.

13. The system according to claim 12 wherein the tips of said jaws are in contact with said tile support and wherein the body area of said jaws can fit around a pole without separating the tips of the jaws from their contact with said tile support.

14. The system according to claim 13 wherein the clamp has a spring set inside the handles to provide a suitable force to press and hold the tip of each of the jaws toward the other.

15. The system according to claim 14 wherein the spring is a torsion spring held in place by the axis the handles and jaws rotate about.

16. The system according to claim 15 wherein each of the jaws ends in a tip that is no more than 1/16th of an inch thick.

17. The system according to claim 16 wherein opposite the tips are flanges that form with the tips a generally U-shaped opening.

18. The system according to claim 12 further comprising a gasket for use between a wall and a pole, said gasket comprising a top end and a bottom end and a pole side and a wall side, said pole side having a groove that extends from the top end to the bottom end, said groove being adapted to mate with an outside surface of the pole, and wherein said wall end of the gasket ends in a pair of wings that extend outwardly from a core.

19. The system according to claim 18 wherein said wings butt up against the wall creating a seal to provide dust containment.

20. The system according to claim 19 wherein said wings extend apart from each other so that when they butt up against the wall one wing is on one side of said curtain and the other wing is on the other side of the curtain.

* * * * *